US006070399A

United States Patent [19]

Huang et al.

[11] Patent Number: 6,070,399

[45] Date of Patent: Jun. 6, 2000

[54] GUIDE FEEDING DEVICE FOR A THERMAL SHRINKING FILM MECHANISM

[76] Inventors: Fu-Chuan Huang, No. 111-11, Chung Chuang Tsun, Shui Shang Hsiang, Chia I Hsien; Chin-Tsai Wu, 2 Fl., No. 4, Lane 90, Chang Chiang Rd.; Chien-Tsai Huang, No. 146, Sec. 1, Chung Shan E. RD., both of Chung Li City, Tao Yuen Hsien, all of Taiwan

[21] Appl. No.: 09/119,628

[22] Filed: Jul. 21, 1998

[51] Int. Cl.[7] ..... B65B 7/28

[52] U.S. Cl. ..... 53/585; 53/291; 53/296

[58] Field of Search ..... 53/585, 290–298, 53/575, 576; 493/478, 479

[56] References Cited

U.S. PATENT DOCUMENTS

| | | | |
|---|---|---|---|
| 3,242,635 | 3/1966 | Kobick | 493/479 |
| 4,806,187 | 2/1989 | Fujisawa | 53/585 X |
| 4,922,683 | 5/1990 | Connolly | 53/585 X |
| 5,203,760 | 4/1993 | Chen et al. | 493/479 |
| 5,737,900 | 4/1998 | Konstantin et al. | 53/585 X |

*Primary Examiner*—Linda Johnson
*Attorney, Agent, or Firm*—Varndell & Varndell, PLLC

[57] ABSTRACT

The present practical new design is to provide a guide feeding device for thermal-shrinking film mechanism that mainly is related to the feed wheels which are mounted on the upper, middle and lower peripherals of the central guide rod and all connected by the connecting rod. The transmission gears are driven by a motor to let another meshed transmission gear adverse transmitted correspondingly and to stably transport the shrinking film downwards. By the opposed reverse threads at both ends of an axial rod, each feed wheel is mounted on the corresponding reverse thread and an adjusting wheel is mounted on the other end of the axial rod. And it only needs to rotate the adjusting wheel and move the two mutual opposed feed wheels along the axial rod in or out correspondingly to adapt the central guide rods with different sizes. The adjustment is very convenient and fast, and is able to upgrade the producing efficiency and the product quality.

2 Claims, 8 Drawing Sheets

GUIDE FEEDING DEVICE FOR A THERMAL SHRINKING FILM MECHANISM

BACKGROUND OF THE INVENTION

The quality of life has improved as a result of progress in industry and business. Consumer appeal is now more emphasized when considering the packaging design of products. More specialically businessmen have modified the outside package design of the product by printing advertisements on the shrinking-film of the package. However, the thermal setting method for sleeving the shrinking-film label on the bottle or can of the prior art mainly comprises cutting the flattened shrinking-film sleeve by manpower according to the needed size. The shrinking-film is then expanded to sleeve it onto the bottle or can, which is then transported to the heating device to heat and shrink-fix the shrinking film sleeve. But the speed is too slow by using the manpower for sleeving, and the production rate and working efficiency are not good enough. Thus, it has become the major topic for the businessmen to develop the automatic labeling machine. Currently, the sleeving method for the shrinking-film has advanced to automatic sleeving. The ordinary guide feeding device of shrinking-film mainly comprises a central guide shaft 1 (please refer to that shown in FIG. 1). A vertical guide plate 10 is mounted on the conical portion of the top end such that a first shrinking-film A of the flatten surface sleeves onto the guide plate 10 from a smooth status, Then the shrinking-film A sleeves onto the guide shaft 11, and the shrinking-film A is clamped and fed downwards by the pressing feed wheels 12, 13 mounted between both ends of guide shaft 11. These pressing feed wheel 12, 13 are driven by the motor 14 that drives the belt 15 and belt wheel 16, then the shrinking-film is cut by the cut blade device 17. After cutting, the shrinking-film A is pushed down on top, then guided by the guide wheel 18 to drop down and sleeve on the bottle or can. This is followed by delivering the bottle or can with the sleeved shrinking-film to the heating device for the heat-shrinking process to get a automatic packaged bottle or can with finished shrinking-film. However, in the guide feeding device of the shrinking-film in the prior art, the pressing feed wheel 12, 13, belt wheel 16 and blanking guide wheel 18 are all fixedly mounted, and therefore, it is hard to adjust their mounting positions. Due to various bottles or cans with different sizes, the central guide shaft 1 should be changed to the proper size accordingly, and the pressing feed wheel 12, 13 of both sides of the central guide shaft 1 and the blanking guide wheel 18 also have to be adjusted accordingly. Since the traditional pressing feed wheel 12, 13, belt wheel 16 and blanking guide wheel 18 are all of the fixed type, it is necessary to disassemble the whole set then readjust and assemble again. The corresponding motor 14, belt 15 and belt wheel 16 have to be adjusted accordingly, and it takes a lot of time and work. The transmission method of each of the pressing feed wheels 12, 13 is driven by a belt. The stability of belt transmission is poor and the pressing feed wheels are often unable to rotate synchronously such that the shrinking-film will be shifted such that one side is high and the other side is low and the shrinking-film A cannot be transmitted smoothly. Moreover the method of pushing delivery will squeeze the shrinking-film easily and wrinkling will occur at the cutting edge of the shrinking-film A. Also, the shrinking-film will be unable to be guided smoothly by the blanking guide wheel 18 and flatten-sleeved on the bottle and can, and will increase the failure rate of the process.

SUMMARY OF THE INVENTION

A guide feeding device for a thermal-shrinking mechanism, where the feeding wheels mounted on the upper, middle and lower peripherals of the central guide shaft are all connected by connecting rods. Each connected feed wheel is rotated synchronously by the transmission of belt and belt wheel to stably drive the shrinking-film to transport downwards. It can only rotate the adjusting wheel such that two opposed feed wheels may relatively move in or out along an axial rod by the opposed reverse threads at both ends of an axial rod which has an adjusting wheel mounted on one end to adapt to different sizes of the central guide shaft. The adjustment is very convenient and fast. The guide feeding device for heat shrinking-film mechanism according to the present invention can increase the production efficiency and upgrade the product quality.

DETAILED DESCRIPTION OF THE PREFERRED EMBODIMENT

Figure 1:
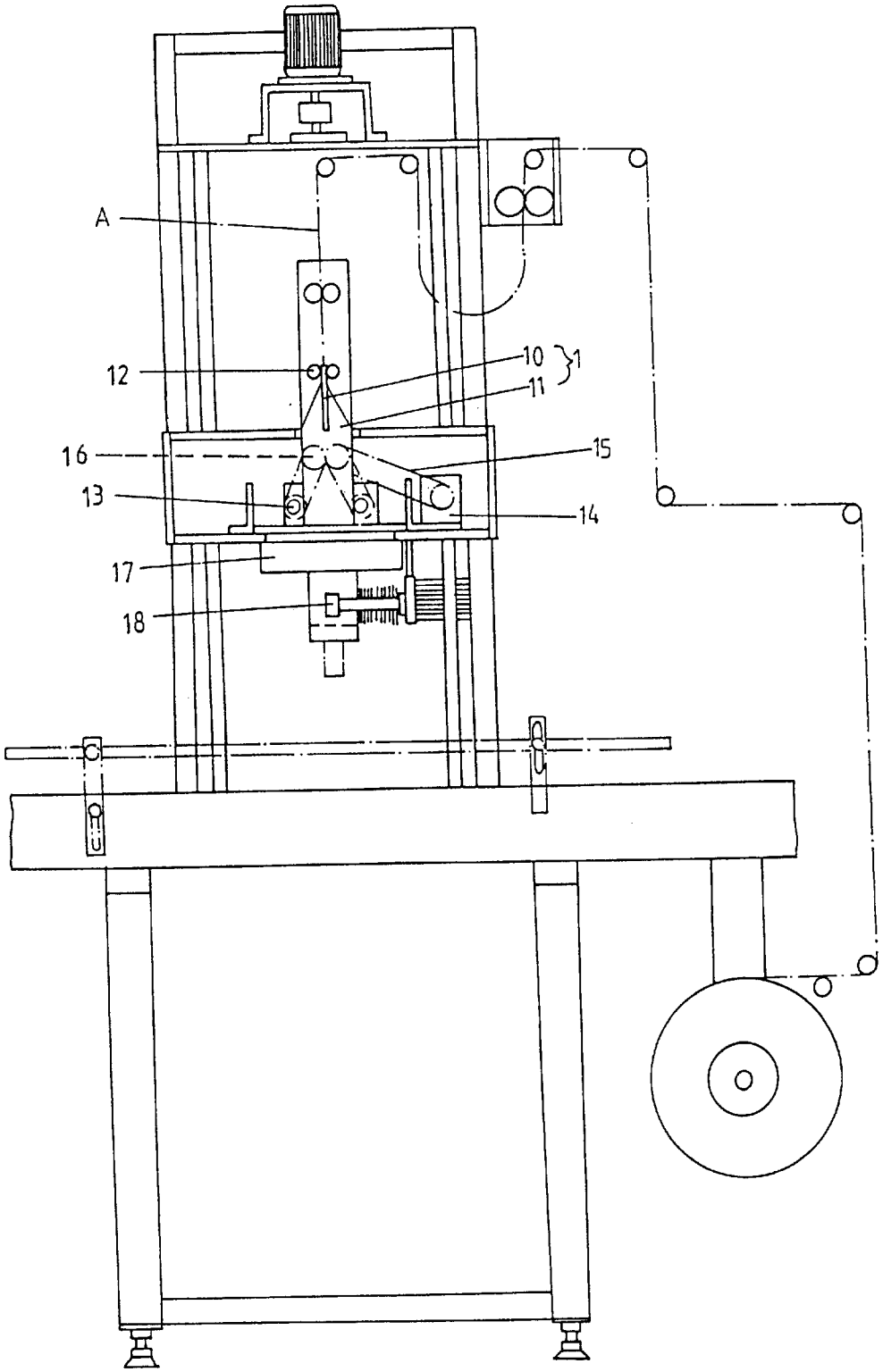
FIG.1 PRIOR ART
FIG. 1 shows the schematic view of a guide feeding device of a thermal-shrinking film according to the prior art.
Figure 2:
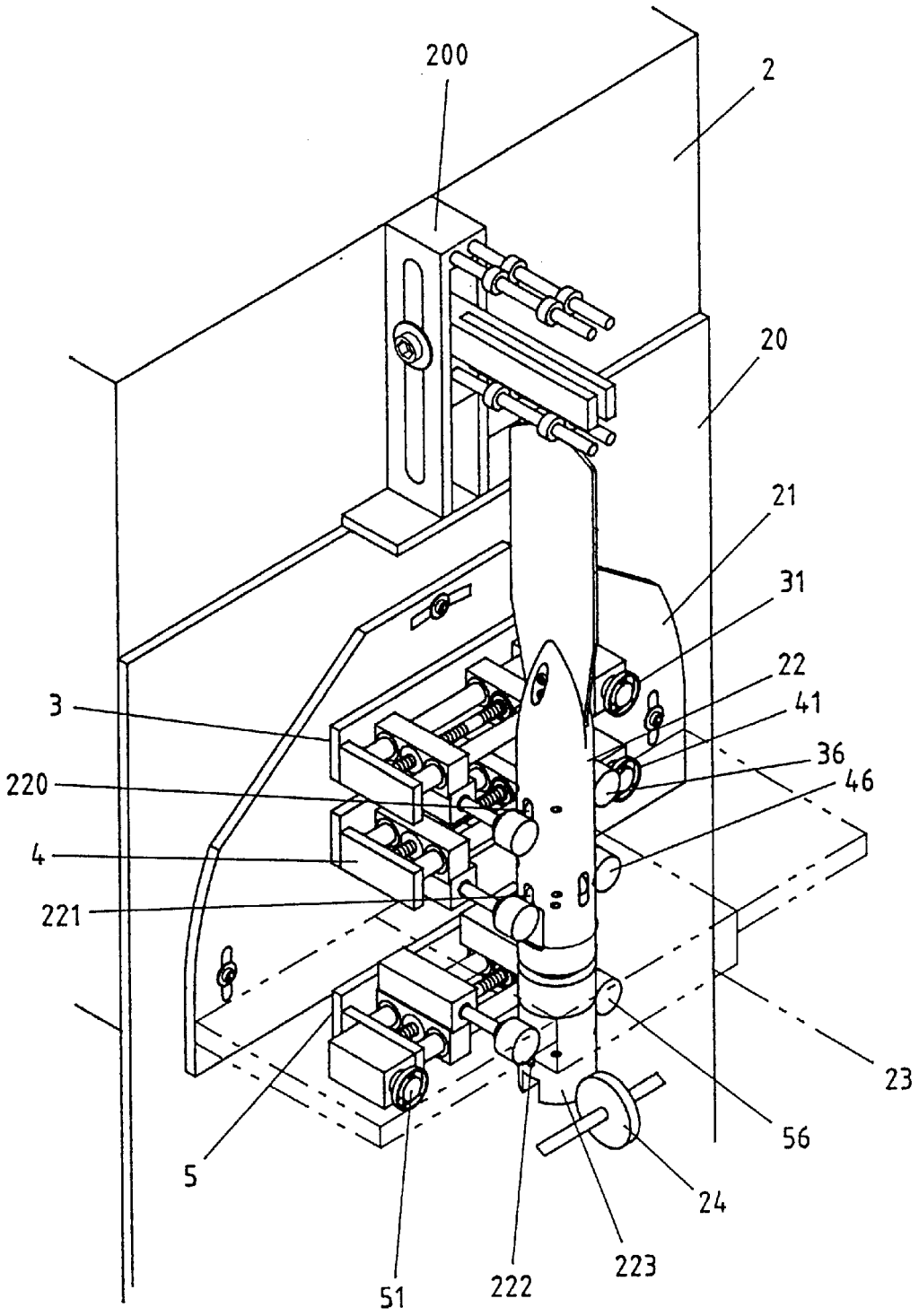
FIG. 2 shows a perspective schematic view according to the present invention.
Figure 3:
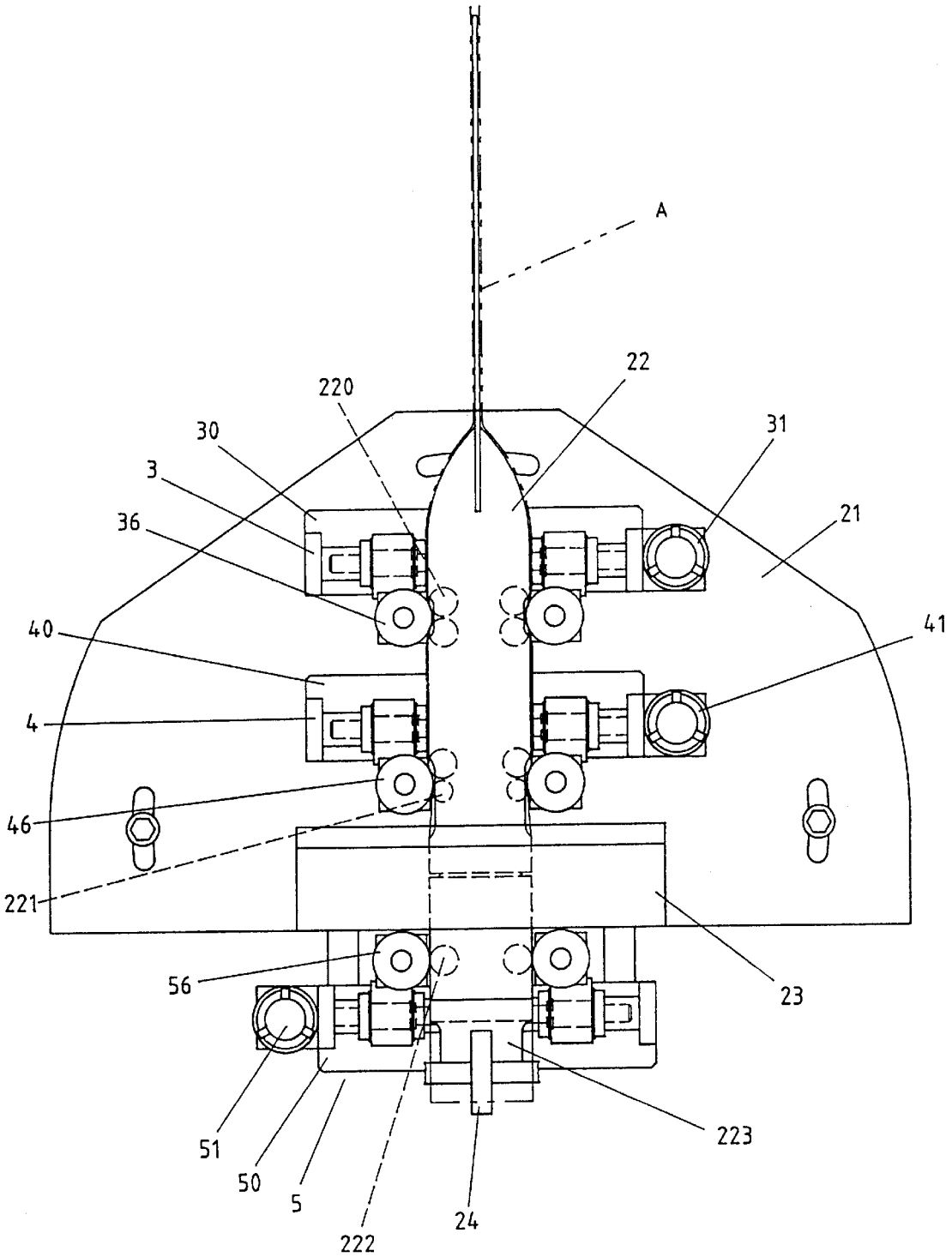
FIG. 3 shows a front view according to the present invention.
Figure 4:
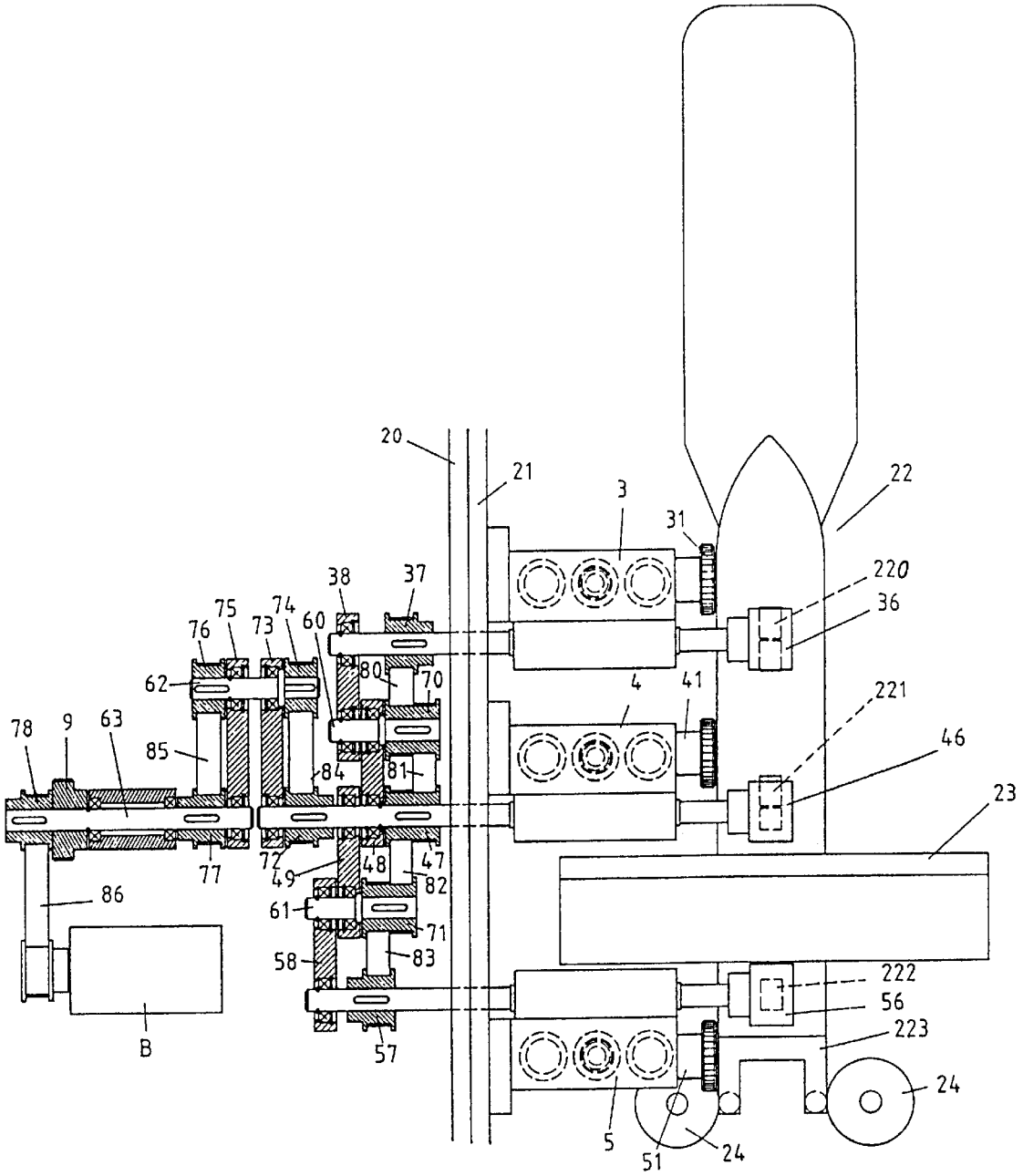
FIG. 4 shows a side view according to the present invention.
Figure 5:
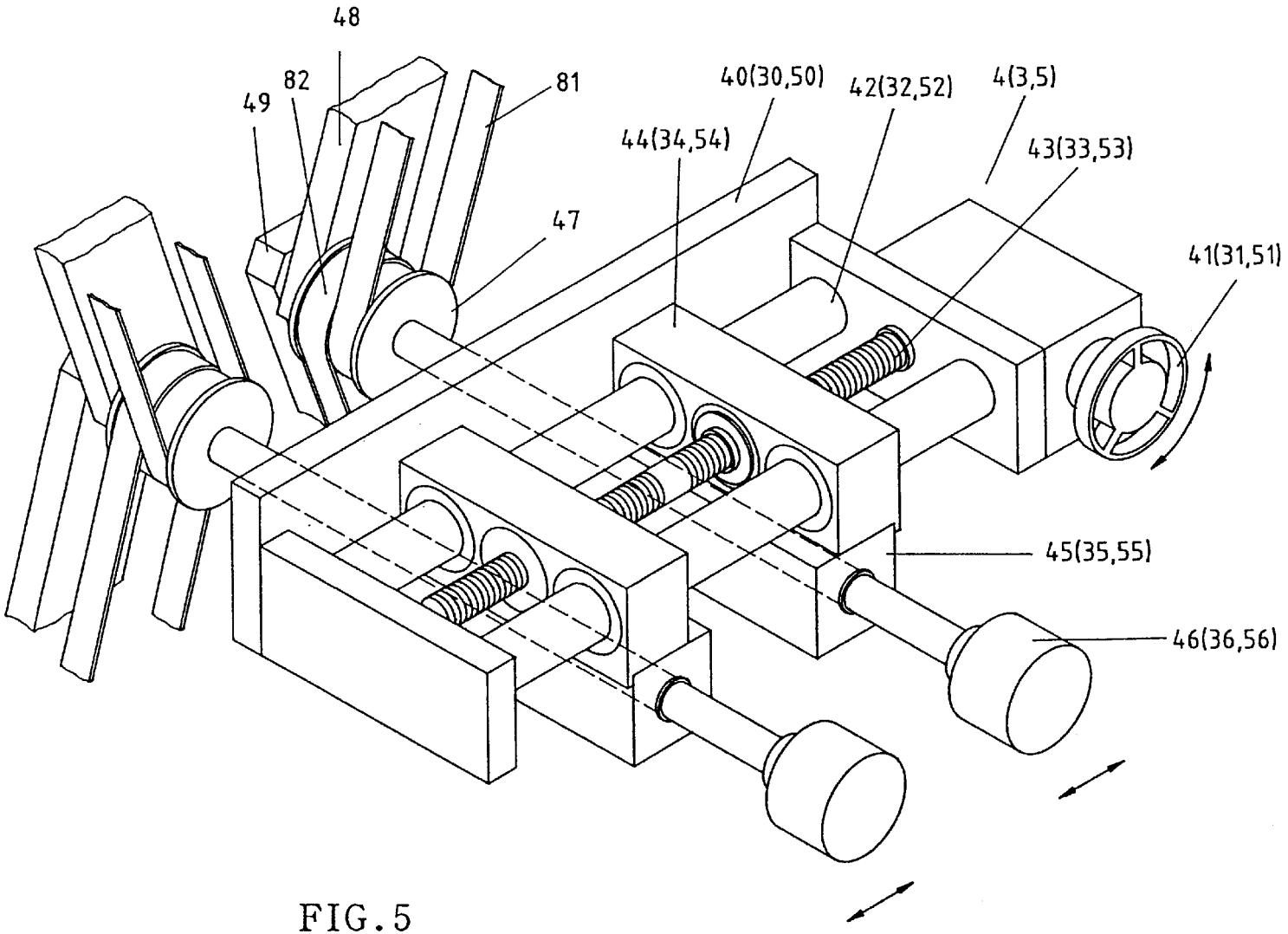
FIG. 5 shows a perspective schematic view of the feed wheel set according to the present invention.

Referring to FIGS. 2, 3, 4, the present invention includes a fixed plate 20 mounted on the frame 2. An electrical eye frame 200 is mounted on top of the fixed plate 20, and an adjustable rotary dish 21 is mounted on the top of the fixed plate 20. A feed wheel sets 3, 4, 5 are respectively mounted on upper, middle and lower peripheries of the central guide rod 22 in the frame 2. Guide wheels 220, 221, 222 are mounted on the corresponding locations of the central guiding shaft 22 and feed wheel sets 3, 4, 5. A detachable guiding shaft 223 is mounted in the lower end portion of the central guide shaft 22. A cutting blade device 23 is mounted near the lower end of the central guide shaft 22, and a blanking wheel is mounted at the lower end of the central guide shaft 22. Each of feed wheel sets 3, 4, 5 has a base 30,40,50(as shown in FIG. 5) and the adjusting wheels 31, 41, 51 are mounted at one side of the base. Two guiding rods 32, 42, 52 are mounted between the base 30, 40, 50 and one axial rod 33, 43, 53 is mounted between the guiding two rods 32, 42, 52. Both ends of the axial rod 33, 43, 53 are mounted with the opposed reverse threads and there are guide blocks 34, 44, 54 mounted on the corresponding opposed reverse threads. There are wheel bases 35, 45, 55 connected securely under the guide blocks 34, 44, 54 and feed wheels 36, 46, 56 are mounted inside the wheel bases 35, 45, 55. The belt wheels 37, 47, 57 and the connecting rods 38, 48, 49, 58(as shown in FIGS. 4, 5) are mounted on the back side of the feed wheels 36, 46, 56. Two of the connecting rods 38, 48, 49, 58 are connected by a movable sub-axis 60, 61 and there are connecting belt wheels 70, 71 mounted on the sub-axis 60, 61. The transmission between the belt wheels 37, 47, 57 and the connecting belt wheels 70, 71 are sleeve-transmitted by the belts 80, 81, 82, 83. There is another belt wheel 72 and connecting rod 73 mounted on the back side of the feed wheel 46. A movable sub-axis 62 and a belt wheel 74 are mounted on the other end of the connecting rod 73 to be aligned with the feed wheel 46 of the belt wheel 72 and sleeve-transmitted by the belt 84. There are also a connecting rod 75 and a belt wheel 76 mounted on the other end of the movable sub-axis 62. A fixed sub-axis 63 is mounted on the other end of the connecting rod 75. A belt wheel 77 is mounted on the fixed sub-axis 63 and in the corresponding location of and a belt wheel 76 of the movable sub-axis 62. The transmission between belt wheels 76 and 77 is driven by a belt 85. A transmission gear 9 and a belt wheel 78 are mounted on the other end of fixed sub-axis 63. A motor B with a belt 86 drives the complete mechanism, and drives a transmission gear 9 to mesh with another transmission gear 9. Thus it is able to drive the two corresponding feed wheels 36, 46, 56 of each of the feed wheel sets 3, 4, 5 synchronously and to rotate them relatively.

When a distance between feed wheels 36, 46, 56(as shown in FIG. 3) is to be adjusted, all that is required is to rotate the adjusting wheels 31, 41, 51 to drive the axial rods 33, 43, 53 rotating such that two corresponding guide blocks 34, 44, 54 will move in or out relatively along the corresponding threads of the axial rods 33, 43, 53 and drive the feed wheels 36, 46, 56 moving relatively to adjust the distance. The feed wheel 36, 46, 56 are adjusted according to the size of the central guide shaft 22 and contact with the guide wheel 220, 221, 222 of the central guide shaft 22, such that the transporting tensile force will reach an optimum during transportation. The feed wheels 36, 46, 56 are connected by the connecting rods 38, 48, 49, 58, 73, 75 and driven synchronously by the belt wheels 37, 70, 47, 71, 57, 72, 74, 76, 77, 78 and the belts 80, 81, 82, 83, 84, 85, 86 such that each of the feed wheels 36, 46, 56 can rotate synchronously and stably transport the shrinking-film A. No shift in transportation occurs for the shrinking-film A and the shrinking-film A is driven down and then transported by the rotation of the feed wheels 36, 46, 56. Therefore, no wrinkle occurs in the shrinking-film A and the shrinking-film A can be sleeved on the bottle or can flatly to upgrade the packaging quality.

Figure 6:
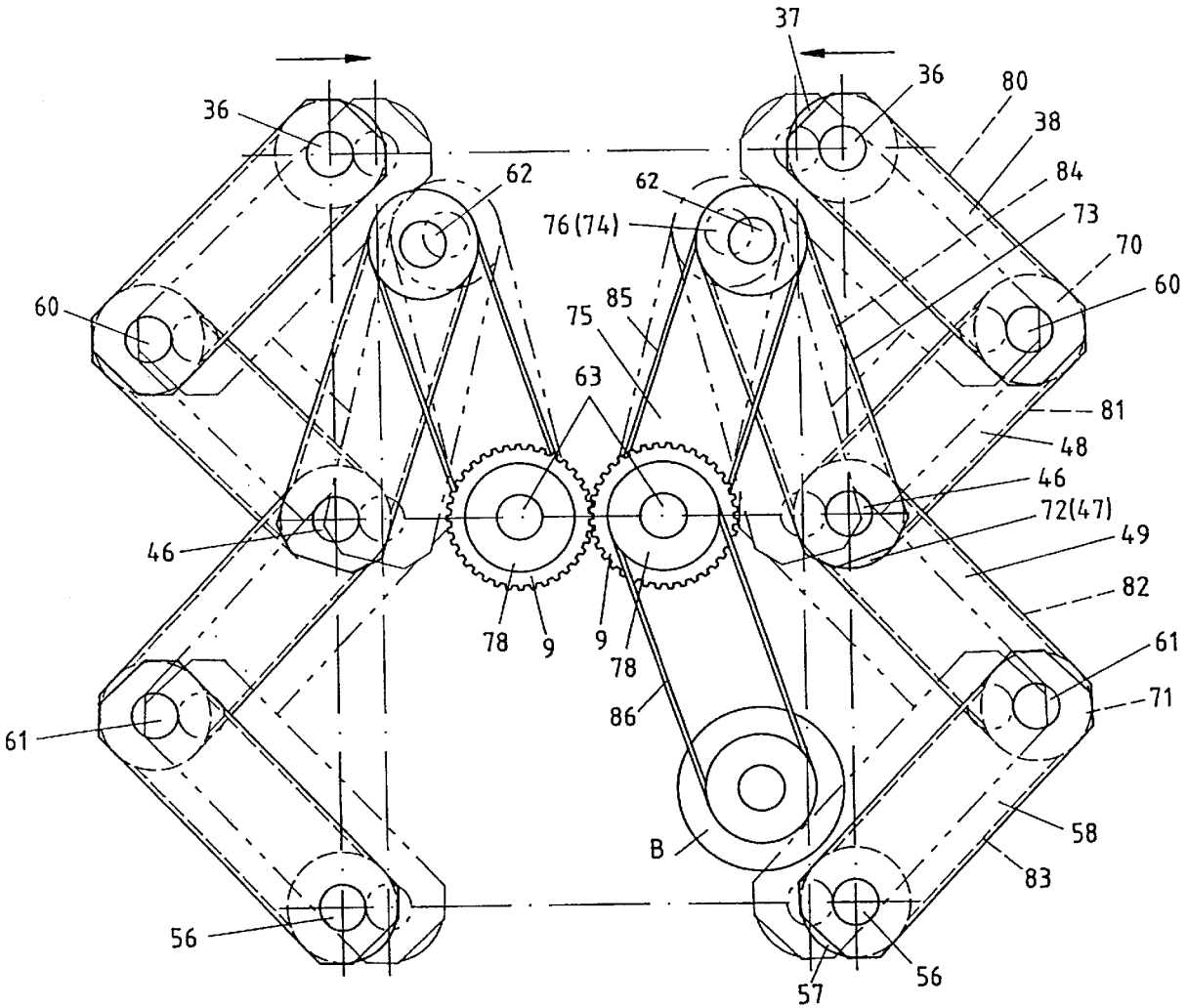
FIG. 6 shows a schematic view of a feed wheel according to the present invention where the connecting elements will move accordingly while the feed wheel moves.
Figure 7:
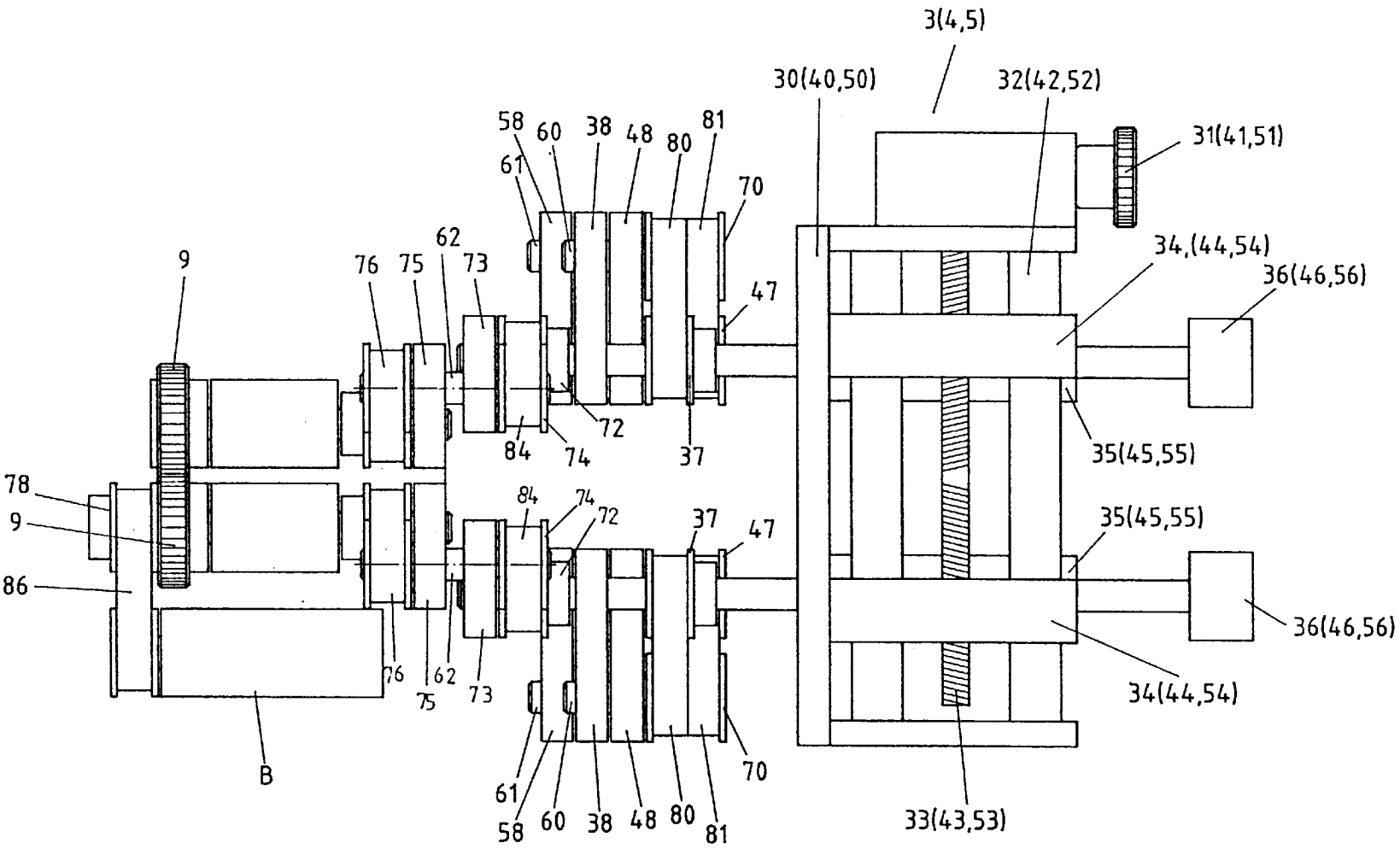
FIG. 7 shows a top view according to the present invention.

When the feed wheel 36, 46, 56 are adjusted to move(as shown in FIG. 6), every connecting rod 38, 48, 49, 58, 73, 75 mounted on the back of the feed wheel 36, 46, 56 is also moved or swung accordingly, and the transmitting members on the back of the two corresponding wheels 36, 46, 56 mounted on every feed wheel set 3, 4, 5 are driven by the meshed transmitting of a transmission gear 9 such that two corresponding wheels 36, 46, 56 are reversed rotating and transmitting only by a transmitting motor B. All the members are linkage mounted and need no adjustment, and the only need is to adjust the feed wheel 36, 46, 56 such that the adjusting time will be reduced and the mounting of the other motor will be also saved to reduce the manufacturing cost. Since a constant length of the belt 80, 81, 82, 83, 84, 85, 86 can be limited by the length of each connecting rod 38, 48, 49, 58, 73, 75, the complete set of members also need no adjustment in each transmitting belt 80, 81, 82, 83, 84, 85, 86 and will move with the movement of movable sub-axis 60, 61. Only the adjusting wheel 31, 41, 51 needs to be rotated to move the feed wheels 36, 46, 56 to a fixed position, therefore there is no need to adjust the length of each belt and the adjusting operation can be finished more rapidly.

Figure 8:
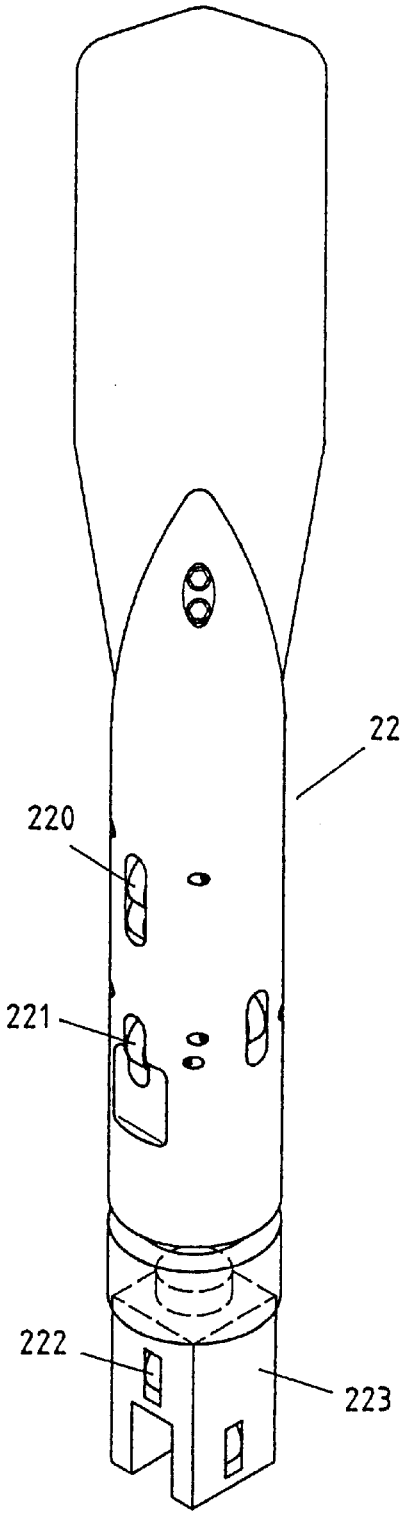
FIG. 8 shows a perspective schematic view for the guiding shaft of a lower portion of a central guide shaft according to the present invention.

Further, the complete set of members is able to make any adjustment according to the shape of bottle or can. If the head or body of such bottle or can are inclined by an angle, only needs to the rotary dish 21 must be adjusted to rotate by an angle to fit the inclined angle of the bottle or can to be sleeved. Since the feed wheel sets 3, 4, 5 are fixed to the rotary disk 21, the feed sets are able to incline with the rotary disk 21 and need no adjustment. Furthermore, in order to fit with the various bottle or can of different sizes which are to be sleeved with the shrinking-film, the present invention includes a detachable guiding shaft 223 of the lower end of the central guide shaft 22. It is possible to change the guiding shaft 223 of the central guide shaft 22 into square, polygon or ecliptics . . . etc.(as shown in FIG. 8). If the guiding shaft 223 of the central guide shaft 22 is square, the both ends of a flat body on top of the central guide shaft 22 also have to be adjusted to align with a diagonal of the square guiding shaft 223, such that the pressing fitting line of the shrinking-film A can align with the sleeve. Correspondingly, an electric eye frame 200 mounted on top of the central guide shaft 22 also has to be adjusted to align with the flat body of the central guide shaft 22, such that the sleeving alignment can be more convenient and stable while sleeving the shrinking-film A, and can attain the best quality of manufacturing.

By summarizing the above descriptions, it is to be noted that the present invention can actually achieve the expected purpose, effect and high efficiency of producing performance in practice.

Having described and illustrated the principles of the invention in a preferred embodiment thereof, it should be apparent that the invention can be modified in arrangement and detail without departing from such principles. We claim all modifications and variation coming within the spirit and scope of the following claims.

What is claimed is:

1. A guide feeding device for a thermal-shrinking film mechanism, comprising:

a frame having a central guide shaft;

a fixed plate mounted on the frame;

an electric eye frame mounted on the fixed plate;

a plurality of feed wheel sets respectively mounted on upper, middle and lower peripheries of the central guide shaft;

a cutting blade device mounted proximate to a bottom end of the central guide shaft; and a blanking wheel mounted at the bottom end of the central guide shaft;

wherein each of the plurality of feed wheel sets comprises:

a base;

an adjusting wheel mounted at one side of the base;

guiding rods mounted to the base;

an axial rod mounted to the base;

a plurality of guide blocks, wherein both ends of the axial rod are mounted to at least one of the guide blocks with opposed reverse threads;

a plurality of wheel bases fixedly fastened respectively under the guide blocks;

a plurality of feed wheels respectively mounted to the plurality of wheel bases;

a plurality of belt wheels respectively mounted on one end of the plurality of feed wheels; and a plurality of connecting rods respectively mounted on the one end of the plurality of feed wheels;

a movable sub-axis mounted on the other end of each of the connecting rods;

a connecting belt wheel mounted on each of the movable sub-axes to align with at least one of the belt wheels;

wherein at least one of the connecting rods from adjacent feed wheel sets is connected to each of the movable sub-axes;

wherein the belt wheels and the connecting belt wheels are connected by belts;

a fixed sub-axis mounted to one of the connecting rods connected to each of the movable sub-axes;

a first sub-axis belt wheel mounted on an end of each of the sub-axis; and a transmission gear and a second sub-axis belt wheel mounted on the other end of each of the fixed sub-axes, and connected with a motor by a belt.

2. The guide feeding device for a thermal-shrinking film mechanism according to claim 1, further comprising a detachable guiding shaft detachable from a bottom end portion of the central guide shaft.

* * * * *